United States Patent [19]

Fischer et al.

[11] 4,044,521

[45] Aug. 30, 1977

[54] ROOF INSULATION SUPPORT SYSTEM

[76] Inventors: Larry J. Fischer, 809 108th Lane, NW., Coon Rapids, Minn. 55433; Terrence J. McNellis, 608 82nd Ave., North, Brooklyn Park, Minn. 55444

[21] Appl. No.: 692,488

[22] Filed: June 3, 1976

[51] Int. Cl.[2] ..... E04B 1/74; E04F 15/18

[52] U.S. Cl. ..... 52/404; 52/478; 52/479; 52/483

[58] Field of Search ..... 52/404, 484, 489, 359, 52/27, 732, 647, 660, 406, 409, 478, 479, 241, 483, 743, 741, 717, 458; 211/134; 248/243

[56] References Cited

U.S. PATENT DOCUMENTS

| | | | |
|---|---|---|---|
| 3,295,284 | 1/1967 | Tschiesche | 52/483 |
| 3,512,323 | 5/1970 | Hupfer | 52/404 |
| 3,513,614 | 5/1970 | Studzinski | 52/404 |
| 3,514,915 | 6/1970 | Johnson | 52/404 |
| 3,553,915 | 1/1971 | Passovoy | 52/241 |
| 3,618,281 | 11/1971 | Hill et al. | 52/404 |
| 3,662,509 | 5/1972 | Studzinski | 52/404 |
| 3,710,520 | 1/1973 | Federowicz | 52/27 |
| 3,748,998 | 7/1973 | Lambert | 52/732 |
| 3,791,089 | 2/1974 | Alderman | 52/484 |
| 3,961,454 | 6/1976 | Adams | 52/404 |
| 3,979,537 | 9/1976 | Troyer | 52/404 |
| 3,983,600 | 10/1976 | Smith | 52/717 |

*Primary Examiner*—Price C. Faw, Jr.
*Assistant Examiner*—Robert C. Farber
*Attorney, Agent, or Firm*—Merchant, Gould, Smith, Edell, Welter & Schmidt

[57] ABSTRACT

A roof insulator support system includes a plurality of longitudinally extending beams supporting a plurality of regularly spaced, laterally extending purlins of Z-shaped cross section with an upturned lip portion on the lower flange of each purlin. Elongated liner support members, being extrusions of a generally inverted T-shape, are attached to and extend along the bottom of each purlin. Each liner support member is attached to a purlin by the interaction of a clip member which engages the lip portion of the purlin and a clip flange which engages the bottom of the lower flange of each purlin to prevent vertical displacement thereof. The horizontal portions of liner support members on adjacent pairs of purlins support roof liner panels laid between the purlins. A layer of insulation material is laid on top of the roof liner panels and a roof extends over the purlins.

11 Claims, 5 Drawing Figures

ROOF INSULATION SUPPORT SYSTEM

BACKGROUND OF THE INVENTION

1. Field of the Invention

This invention relates to the field of insulated roof structures and more particularly to the field of supporting roof liner panels and insulation material in commercial structures.

2. Description of the Prior Art

In the construction of a roof for a building, usually a plurality of longitudinally extending beams are regularly spaced at predetermined distances from each other, for example, 18, 20, or 24 feet, to form a plurality of longitudinally extending bays. These beams support a plurality of laterally extending purlins, also regularly spaced at predetermined distances, such as five feet, from each other. The purlins are usually of a cross section, such as a "C" or "Z" shape, providing a lower flange. The lower flange of each purlin is firmly secured to the beams by appropriate rivets or screws.

After the purlins are secured to the beams, roof liner panels of a predetermined width corresponding to the distance between the purlins, such as five feet, are attached to the lower flanges of adjacent pairs of purlins by means of screws or rivets.

Batts of insulation material are then rolled out between the purlins on top of the roof liner panels, and roof panels are then securely fastened to the top flanges of the purlins.

The process of attaching the roof liner panels to the lower flanges of the purlins by means of rivets or screws is a very time consuming one, involving difficult working conditions, and resultant higher labor costs. Furthermore, the use of metal roof panels, steel purlins, and steel rivets or screws in such conventional roof structures creates a continuous path of thermal conductivity running from the roof, through purlins and fasteners, to the inside of the building. In cold weather the interaction of this thermal path with the heated inside air can result in condensation of moisture on the liner panel fasteners, and the dripping of water from the ceiling inside the building.

SUMMARY OF THE INVENTION

The present invention is an improved roof structure which significantly increases the labor efficiency, and thus significantly decreases the labor costs for assembling an insulated roof, by eliminating the need to attach the roof liner panels to the lower flanges of the purlins with screws or rivets. In many applications the time required to install such a roof can be cut to 20–25% of present time requirements by using the present invention.

The elimination of the need for additional fasteners to attach the roof liner panels to the purlins is accomplished in the present invention by means of a plurality of liner support members depending from the lower flanges of the purlins.

In one embodiment of the invention the liner support members are elongated plastic extrusions extending along and under the purlins for the full width of the bays formed by the beams. Each liner support member has a generally inverted T-shaped cross section. At the top of the upstanding portion of the inverted "T" a clip portion is formed, which comprises a downturned clip channel for engaging the upturned lip portion on the lower flange of a purlin, and a clip flange for engaging the bottom surface of the lower flange of a purlin. A liner support member is clipped to the lower flange of each purlin.

The horizontal portions of the inverted "T" on liner support members clipped to the lower flanges of adjacent pairs of purlins provide support surfaces for the roof liner panels, which are laid between the purlins. The roof liner panels are of a width generally equal to the distance between adjacent purlins, so that when the panels are laid horizontally between the purlins, their outer side edges will overlay, and rest on, the horizontal portions of the liner support members clipped to the lower flanges of adjacent purlins.

The use of plastic liner support members in the present invention creates a thermal break between the outside and inside of the roof structure, thus eliminating the condensation problem present in the conventional roof structure outlined above. The costs saved in labor are substantial, and if desired can be expended on more insulation material, thus leading to lower heating bills and energy conservation.

DESCRIPTION OF THE PREFERRED EMBODIMENT

Figure 1:
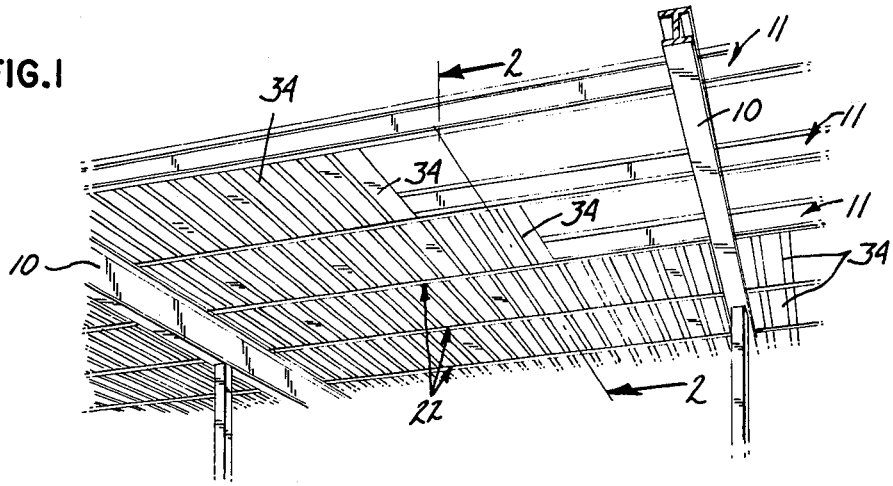
FIG. 1 is a fragmentary perspective as seen from the bottom of a roof structure.

FIG. 1 shows a portion of the roof structure of a building which includes a plurality of longitudinally extending beams 10. These beams are standard steel I-beams. The number of beams 10 in the roof structure depends upon the dimensions of the building. The beams 10 are regularly spaced at a predetermined distance from each other, such as 18 feet, 20 feet, or 24 feet. The beams 10 support a plurality of laterally extending steel purlins 11. The purlins 11 are securely attached to the beams 10 by means of screws or rivets, and are regularly spaced at a predetermined distance, such as 5 feet, from each other.

Figure 3:
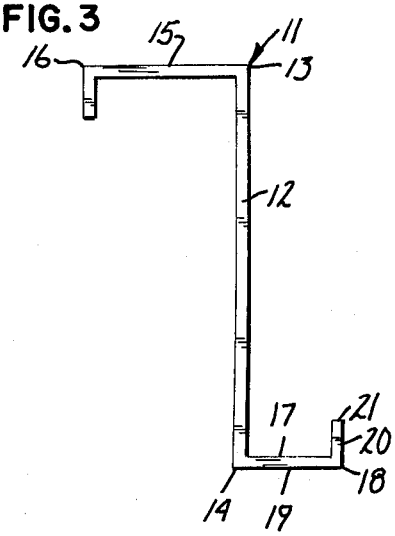
FIG. 3 is a view in end elevation of a purlin.

As shown in FIG. 3, the purlins 11 have a generally Z-shaped cross section, including a vertically oriented webb 12 with a top edge 13 and a bottom edge 14. A top flange 15, with an outer edge 16, extends from top edge 13. Top flange 15 is perpendicular to webb 12. A bottom flange 17, with an outer edge 18 and a bottom surface 19, extends from bottom edge 14. Bottom flange 17 is perpendicular to webb 12. A lip portion 20 with a top edge 21 extends upwardly from outer edge 18 so that lip portion 20 is parallel to webb 12.

Figure 2:
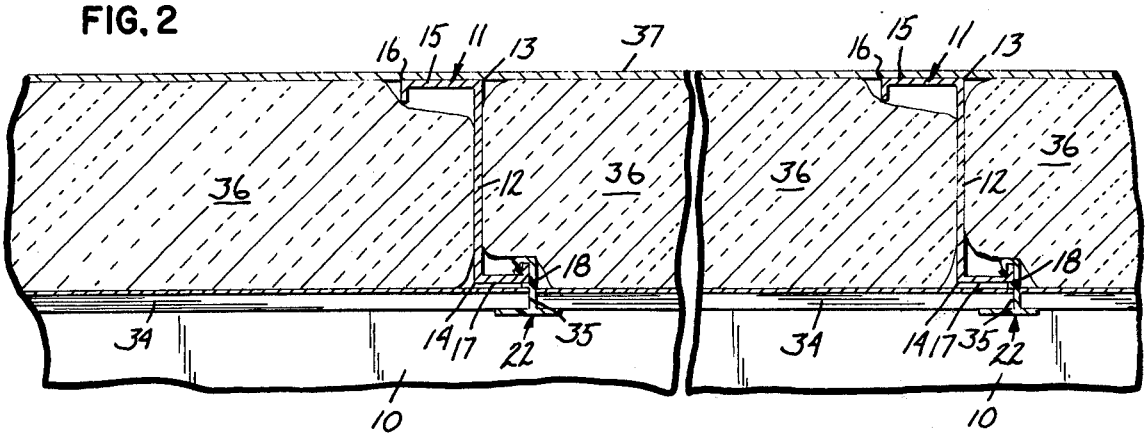
FIG. 2 is a sectional view taken generally along the line 2—2 of FIG. 1.
Figure 4:
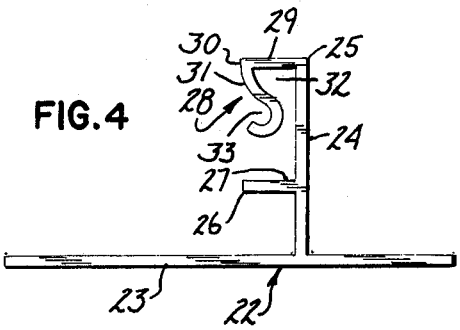
FIG. 4 is a view in end elevation of a liner support member.

Liner support members 22 depend from each of the laterally extending purlins 11. In the preferred embodiment, the liner support members 22 are extrusions of a rigid plastic such as PVC. As shown in FIG. 4, each liner support member 22 has a generally inverted T-shaped cross section including a lower horizontal portion 23 and an upstanding portion 24 perpendicular to lower horizontal portion 23, having a top edge 25. At the top edge 25 a clip member 28 is formed. In the preferred embodiment, the clip member 28 comprises a top wall 29 extending perpendicularly from top edge 25 of the upstanding portion 24 and a nonplanar side wall 31 extending generally downwardly from an outer edge 30 of top wall 29, so that the upstanding portion 24, the top wall 29, and the side wall 31 form a three-sided channel 32 into which the lip portion 20 of a purlin 11 may be placed. A portion 33 of the side wall 31 is curved in such a way as to gradually approach the upstanding portion 24 of the liner support member 22 so that the distance between the portion 33 of the side wall 31 and the upstanding portion 24 of the liner support member 22 is slightly less than the thickness of the lip portion 20 of a purlin 11. The portion 33 of the side wall 31 will thus frictionally engage the lip portion 20 of a purlin 11 which is fitted into the channel 32. A clip flange 25 with a top surface 27 extends perpendicularly from the upstanding portion 24. The distance between the clip flange 26 and the top edge 25 is generally equal to the distance between the bottom surface 19 of the bottom flange 17 and the top edge 21 of the lip portion 20 of a purlin 11, so that when the clip member 28 engages the lip portion 20, the top surface 27 of the clip flange 26 engages the bottom surface 19 of the bottom flange 17 of the purlin 11 as shown in FIG. 2. The combination of the clip member 28 and the clip flange 26 provides means to engage the lip portion 20 and bottom surface 19 of the bottom flange 17 of a purlin 11 and prevent vertical displacement of the liner support member 22.

Figure 5:
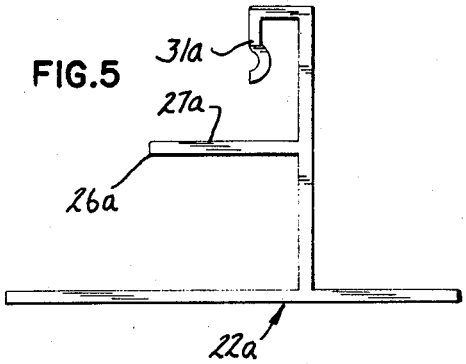
FIG. 5 is a view in end elevation of an alternative embodiment of a liner support member.

FIG. 5 shows an alternate configuration for a liner support member 22*a*. The width of clip flange 25*a* and the shape of side wall 31*a* may be varied depending upon the dimensions of purlins 11 being used in the particular roof structure.

A plurality of generally rectangular roof liner panels 34 having opposite side edges 35 are laid horizontally between adjacent pairs of purlins as shown in FIGS. 1 and 2. In the preferred embodiment, the roof liner panels 34 are sheet metal, but other materials such as fiberglass may be used. The width of the roof liner panels 34 corresponds to the distance between the purlins 11, so that when roof liner panels 34 are laid horizontally between adjacent pairs of purlins 11, the roof liner panels 34 are supported by their opposite side edges 35 overlying the lower horizontal portions 23 of liner support members 24 depending from the adjacent pairs of purlins 11 as shown in FIG. 2. A layer of insulation material 36 rests on top of the roof liner panels 34 and extends between the purlins 11, and a roof 37 extends over the purlins 11, as shown in FIG. 2.

To briefly summarize, then, one embodiment of the roof structure disclosed would be constructed by first setting a plurality of longitudinally extending steel I-beams 10 at 24 foot intervals. A plurality of laterally extending steel purlins 11 of Z-shaped cross section would then be placed on top of I-beams 10 at 5 foot intervals, and firmly secured there. Liner support members 22 would then be clipped to the bottom flanges 17 of each of the purlins 11. Sheet metal roof liner panels 34 of 5 foot widths would then be laid horizontally between the purlins 11 and would be supported by the liner support members 22. Insulation material 36 is placed on top of the roof liner panels 22, extending between the purlins 11. A roof 37 is extended above the purlins 11 to complete the building roof structure. Because the liner support members 22 can be hung from the purlins 11 without the use of fasteners, and because the roof liner panels are also supported by the liner support members 22 without the use of fasteners such as rivets or screws, the speed at which the building can be erected is greatly increased, resulting in substantial cost savings.

What is claimed is:

1. A roof structure comprising:

a. a plurality of longitudinally extending beams;

b. a plurality of laterally extending purlins supported by said beams, said purlins each having a vertically oriented webb having a bottom edge, a bottom flange perpendicular to said webb and extending horizontally from said bottom edge of said webb, said bottom flange having an outer edge and a bottom surface, and a lip portion extending upwardly from said outer edge of said bottom flange so that said lip portion is parallel to said webb portion;

c. an elongated liner support member depending from each of said purlins, each said liner support member having a generally inverted T-shaped cross section comprising a lower horizontal portion, an upstanding portion perpendicular to said horizontal portion, and clip means to engage said lip portion of said purlin to support said liner support member; and d. a plurality of roof liner panels each having opposite side edges, said panels being laid horizontally between adjacent pairs of said purlins, supported by said side edges overlying said lower horizontal portions of adjacent pairs of said liner support members depending from said adjacent pairs of purlins.

2. A roof structure comprising:

a. a plurality of longitudinally extending beams regularly spaced at predetermined distances from each other;

b. a plurality of laterally extending purlins supported by said beams and regularly spaced at predetermined distances from each other, said purlins each having a vertically oriented webb having a bottom edge, a bottom flange extending from said bottom edge perpendicular to said webb, said flange having an outer edge, and a lip portion extending upwardly from said outer edge of said bottom flange and having a top edge, so that said lip portion is parallel to said webb portion;

c. an elongated liner support member depending from each of said purlins, each said liner support member having an inverted, generally T-shaped cross section comprising a lower, horizontal portion, an upstanding portion perpendicular to said horizontal portion with a top edge, a clip member at said top edge to engage said lip portion of said purlin, and a clip flange extending from said upstanding portion in a plane parallel to the plane of said horizontal portion, said clip flange being at such a distance from said top edge and of sufficient width to prevent said clip member of said liner support member from disengaging from said purlin in an upward direction;

d. a plurality of generally rectangular roof liner panels each having opposite side edges, said opposite side edges being spaced apart a distance corresponding to said predetermined distance between said purlins, said panels being laid horizontally between adjacent pairs of said purlins, supported by said side edges overlying said lower horizontal portions of adjacent pairs of said liner support members depending from said adjacent pairs of purlins;

e. a layer of insulation material resting on top of said panels and extending between said purlins; and f. a roof extending over said purlins.

3. The roof structure of claim 2 wherein said clip member comprises a top wall extending generally perpendicularly from said top edge of said upstanding portion and having an outer edge, and a nonplanar side wall extending downwardly from said outer edge of said top wall so that said upstanding portion, said top wall, and said side wall form a three-sided channel, a portion of said side wall being formed in such a way as to frictionally engage said lip portion of said purlin when said lip portion is positioned in said channel.

4. The roof structure of claim 3 wherein a portion of said side wall is curved in such a way as to gradually approach said upstanding portion so that the distance between said portion of said side wall and said upstanding portion is slightly less than the thickness of said lip portion of said purlin.

5. The roof structure of claim 2 wherein said clip flange extending from said upstanding portion of each said liner support member has a top surface, and wherein said distance from said clip flange to said top edge of said upstanding portion is generally equal to the distance between said bottom surface of said bottom flange of said purlin and said top edge of said lip portion of said purlin, so that when said clip member engages said lip portion, said top surface of said clip flange engages said bottom surface of said bottom flange.

6. The roof structure of claim 2 wherein said liner support member is a plastic extrusion and said clip member is formed to frictionally engage said lip portion of said purlin.

7. A roof structure comprising:

a. a plurality of longitudinally extending beams regularly spaced at predetermined distances from each other;

b. a plurality of laterally extending purlins supported by said beams and regularly spaced at predetermined distances from each other, said purlins each having a generally Z-shaped cross section including a vertically oriented webb having a top edge and a bottom edge, top and bottom flanges perpendicular to said webb, each of said flanges having an outer edge, said bottom flange extending from said bottom edge of said webb and said top flange extending from said top edge of said webb, and a lip portion extending upwardly from said outer edge of said bottom flange and having a top edge so that said lip portion is parallel to said webb portion;

c. a liner support member depending from each of said purlins, each said liner support member being a plastic extrusion having an inverted, generally T-shaped cross section comprising a lower horizontal portion, an upstanding portion perpendicular to said horizontal portion with a top edge, a hook-like clip member at said top edge to frictionally engage said lip portion of said purlin, and a clip flange extending from said upstanding portion in a plane parallel to the plane of said horizontal portion, said clip flange being at such a distance from said top edge and of sufficient width to prevent said clip member of said liner support member from disengaging from said purlin in an upward direction;

d. a plurality of generally rectangular sheet metal roof liner panels each having opposite side edges, said opposite side edges being spaced apart a distance corresponding to said predetermined distance between said purlins, said panels being laid horizontally between adjacent pairs of said purlins, supported by said side edges overlying said lower horizontal portions of adjacent pairs of said liner support members depending from said adjacent pairs of purlins;

e. a layer of insulation material resting on top of said sheet metal roof liner panels and extending between said purlins; and f. a roof extending over said purlins.

8. A roof structure comprising:

a. a plurality of longitudinally extending beams regularly spaced at predetermined distances from each other;

b. a plurality of laterally extending purlins supported by said beams and regularly spaced at predetermined distances from each other, said purlins each having a vertically oriented webb having a bottom edge, a bottom flange extending from said bottom edge perpendicular to said webb, said flange having an outer edge, and a lip portion extending upwardly from said outer edge of said bottom flange and having a top edge, so that said lip portion is parallel to said webb portion;

c. an elongated, non-metallic liner support member depending from each of said purlins, each said liner support member having an inverted, generally T-shaped cross section comprising a lower, horizontal portion, an upstanding portion perpendicular to said horizontal portion with a top edge,and a clip member at said top edge to engage said lip portion of said purlin;

d. a plurality of generally rectangular roof liner panels each having opposite side edges, said opposite side edges being spaced apart a distance corresponding to said predetermined distance between said purlins, said panels being laid horizontally between adjacent pairs of said purlins, supported by said side edges overlying said lower horizontal portions of adjacent pairs of said liner support members depending from said adjacent pairs of purlins;

e. a layer of insulation material resting on top of said panels and extending between said purlins; and f. a roof extending over said purlins.

9. The roof structure of claim 8 wherein said liner support member is a plastic extrusion.

10. The roof structure of claim 9 wherein each liner support member includes a clip flange extending from said upstanding portion in a plane parallel to the plane of said horizontal portion, said clip flange being at such a distance from said top edge and of sufficient width to prevent said clip member of said liner support member from disengaging from said purlin in an upward direction.

11. The roof structure of claim 10 wherein said clip member is formed to frictionally engage said lip portion of said purlin.

* * * * *